US009694589B1

(12) United States Patent
Lee

(10) Patent No.: US 9,694,589 B1
(45) Date of Patent: Jul. 4, 2017

(54) INK CARTRIDGE

(71) Applicant: WOOSIM SYSTEM INC., Seoul (KR)

(72) Inventor: Il Bok Lee, Gyeonggi-do (KR)

(73) Assignee: WOOSIM SYSTEM INC., Seoul (KR)

( * ) Notice: Subject to any disclaimer, the term of this patent is extended or adjusted under 35 U.S.C. 154(b) by 0 days.

(21) Appl. No.: 15/115,469

(22) PCT Filed: Mar. 26, 2015

(86) PCT No.: PCT/KR2015/002968
§ 371 (c)(1),
(2) Date: Jul. 29, 2016

(87) PCT Pub. No.: WO2016/032082
PCT Pub. Date: Mar. 3, 2016

(30) Foreign Application Priority Data

Aug. 27, 2014 (KR) ..... 10-2014-0112024

(51) Int. Cl.
*B41J 2/175* (2006.01)
*B41J 2/045* (2006.01)

(52) U.S. Cl.
CPC ..... *B41J 2/17553* (2013.01); *B41J 2/04541* (2013.01)

(58) Field of Classification Search
CPC ..... B41J 2/17553; B41J 2/04541
See application file for complete search history.

(56) References Cited

U.S. PATENT DOCUMENTS

2012/0162317 A1* 6/2012 Hirayama ..... B41J 2/04506 347/50
2017/0028722 A1* 2/2017 Chen ..... B41J 2/04541

FOREIGN PATENT DOCUMENTS

JP 2003-182099 A 7/2003
JP 2004-276291 A 10/2004
KR 1999-0020516 U 6/1999
KR 100220136 B1 9/1999
KR 10-0612450 B1 8/2006
KR 10-0782819 B1 12/2007
(Continued)

OTHER PUBLICATIONS

Japanese Patent Abstract (in English of) JP Pub. No. 2003-182099 A, Pub. Date Jul. 3, 2003, downloaded Jul. 14, 2016 from https://www4.j-platpat.inpit.go.jp/eng/.
(Continued)

*Primary Examiner* — Bradley Thies
(74) *Attorney, Agent, or Firm* — Barcelo, Harrison & Walker, LLP

(57) ABSTRACT

The present invention relates to an ink cartridge. The ink cartridge comprises: a space for storing ink; an ink cartridge module having a pair of heads arranged in an offset manner such that a print width is extended; and a flexible printed circuit board connected to the ink cartridge module on a circuit configuration, wherein the ink cartridge module has a cross sectional shape in which two rectangular shapes having long sides and short sides respectively come in close contact with each other such that the long sides of the two rectangular shapes overlap in part, and thus can configure an array in the direction of either the long side or the short side. The ink cartridge according to the present invention can implement various sizes of print widths and various colors by arranging one or more ink cartridge modules adjacent to each other.

8 Claims, 15 Drawing Sheets

(56) References Cited

FOREIGN PATENT DOCUMENTS

| | | | |
|---|---|---|---|
| KR | 10-2010-0092223 | A | 8/2010 |
| KR | 10-1317783 | B1 | 10/2013 |

OTHER PUBLICATIONS

Korean Patent Abstract (in English of) KR Patent No. 100220136 B1, Issue Date Sep. 1 1999, downloaded Jul. 14, 2016 from https://worldwide.espacenet.com/publicationDetails/.
Korean Patent Abstract (in English of) KR Utility Model Pub No. 1999-0020516 U, Pub. Date Jun. 15 1999, downloaded Apr. 14, 2017 from http://engpat.kipris.or.kr/engpat/.
Japanese Patent Abstract (in English of) JP Pub. No. 2004-276291 A, Pub. Date Oct. 7, 2004, downloaded Jul. 14, 2016 from https://www4.j-platpat.inpit.go.jp/eng/.
Korean Patent Abstract (in English of) KR Patent No. 10-0612450 B1, Issue Date Aug. 16, 2006, downloaded Apr. 14, 2017 from http://engpat.kipris.or.kr/engpat/.
Korean Patent Abstract (in English of) KR Patent No. 10-0782819 B1, Issue Date Dec. 6, 2007, downloaded Apr. 14, 2017 from http://engpat.kipris.or.kr/engpat/.
Korean Patent Abstract (in English of) KR Pub No. 10-2010-0092223 A, Pub. Date Aug. 10, 2010, downloaded Aug. 1, 2016 from http://kpa.kipris.or.kr/kpa/.
Korean Patent Abstract (in English of) KR Patent No. 10-1317783 B1, Issue Date Oct. 15, 2013, downloaded Apr. 14, 2017 from http://engpat.kipris.or.kr/engpat/.

* cited by examiner (a)

(b)

(a)

(b)

(a)

(b)

INK CARTRIDGE

CROSS-REFERENCE TO RELATED APPLICATIONS

This application is the national stage for International Patent Cooperation Treaty Application PCT/KR2015/002968, filed Mar. 26, 2015, which claims priority from Korean Patent Application No. 10-2014-0112024, filed Aug. 27, 2014, in the Korean Intellectual Property Office. The entire contents of said applications are incorporated herein by reference for all purposes.

BACKGROUND

Technical Field

The present invention relates to an ink cartridge, and more particularly, to an ink cartridge capable of realizing various sizes of print widths and various colors by adjacently providing one or more ink cartridge modules.

Background Art

An ink cartridge is a replaceable component used in a printing apparatus, such as an inkjet printer, and stores ink ejected onto a print medium, such as paper, during printing. The ink cartridge is also referred to as an inkjet cartridge, and has various shapes and sizes based on a print apparatus being used.

Generally, the ink cartridge includes an ink reservoir having one or more partition walls, and may further include an electronic contact and a chip for communicating with the print apparatus according to manufacturers.

A Piezo-method, a heating method, a bubble jet method, or the like is used as an ejecting method of the ink cartridge. The Piezo-method is a method of printing as a Piezo-element vibrates according to an electric signal to push ink outside a nozzle. In the Piezo-method, a relatively big nozzle is used since an amount of ink is adjustable by controlling a current flowing time, and has an advantage in graphic outputs since various sizes of ink droplets are generated and thus small droplets are generated when minute expression is required and big droplets are generated for a large area. However, since the nozzle is large, it is relatively difficult to increase the number of nozzles, and the nozzle is blocked easily.

The heating method and the bubble jet method are similar in that bubbles are generated via heat and ink is ejected according to expansive force of the bubbles, but in the heating method, a heater is provided opposite to a nozzle and in the bubble jet method, a heater is provided below a nozzle.

The heating method and the bubble jet method have similar overall characteristics. Also, in the heating method and the bubble jet method, the numbers of nozzles are easily increased since structures are simple, and the nozzles are not easily blocked even if air bubbles enter the nozzles since the air bubbles are discharged together with ink. However, since only a certain size of ink droplet is ejected per nozzle, minute expression is difficult, and a print speed is low when a large area needs to be printed.

However, in a general ink cartridge, sizes of ink droplets and colors of ink are fixed, and thus different ink cartridges are used for print apparatuses being used. Also, some products use an array type head corresponding to a width of a print medium for high speed printing, but even in such a case, the array type head is fixed.

Accordingly, an ink cartridge in which a plurality of ink cartridge modules are arbitrarily arranged according to characteristics of a print apparatus needs to be considered.

DETAILED DESCRIPTION OF THE INVENTION

Technical Problem

One or more embodiments of the present invention provide an ink cartridge capable of realizing various print widths and various colors by adjacently providing one or more ink cartridge modules.

Technical Solution

According to an aspect of the present invention, there is provided an ink cartridge including: an ink cartridge module including a space for storing ink and a pair of heads misaligned such that a print width is extended; and a flexible print circuit board connected to the ink cartridge module on a circuit configuration, wherein the ink cartridge module has a cross-sectional shape in which two rectangular shapes having long sides and short sides closely contact each other such that the long sides of the two rectangular shapes partially overlap, and thus are capable of configuring an array in a direction of either the long side or the short side.

A fixing groove for fixing the ink cartridge module to an external fixing plate and aligning a fixed location by inserting a coupling member may be formed on a bottom surface of the ink cartridge module, and a boss and a thread groove for screw-combining with a circuit board in which a circuit for controlling the ink cartridge module is provided may be formed on one side surface of the ink cartridge module.

The flexible printed circuit board and the circuit board in which the circuit for controlling the ink cartridge module may be provided are detachably connected to each other in a connecter manner.

Advantageous Effects

According to the present invention, various print widths and various colors may be realized since one or more ink cartridge modules are arranged in a width direction or a height direction based on characteristics of a print apparatus being used. Also, internal wiring is easy and a print medium is prevented from being jammed during a print operation since a cross-section of a head of the ink cartridge module has an incline raising towards a width direction of the head at two sides based on a horizontal head surface of the head.

DETAILED DESCRIPTION

Best Mode

Hereinafter, one or more embodiments of the present invention will now be described with reference to accompanying drawings.

Figure 1:
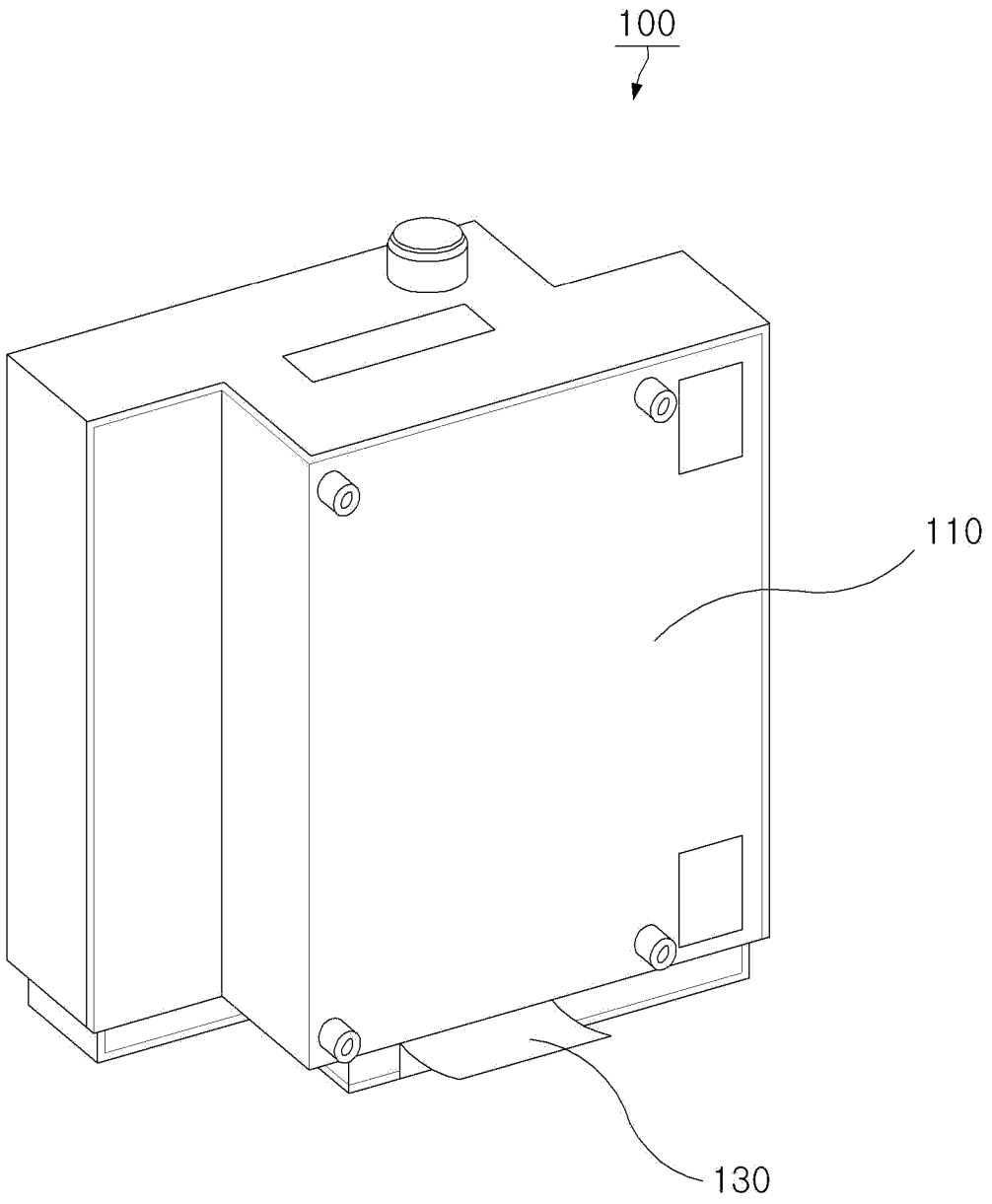
FIG. 1 is a view of an external shape of an ink cartridge, according to an embodiment of the present invention.
Figure 2:
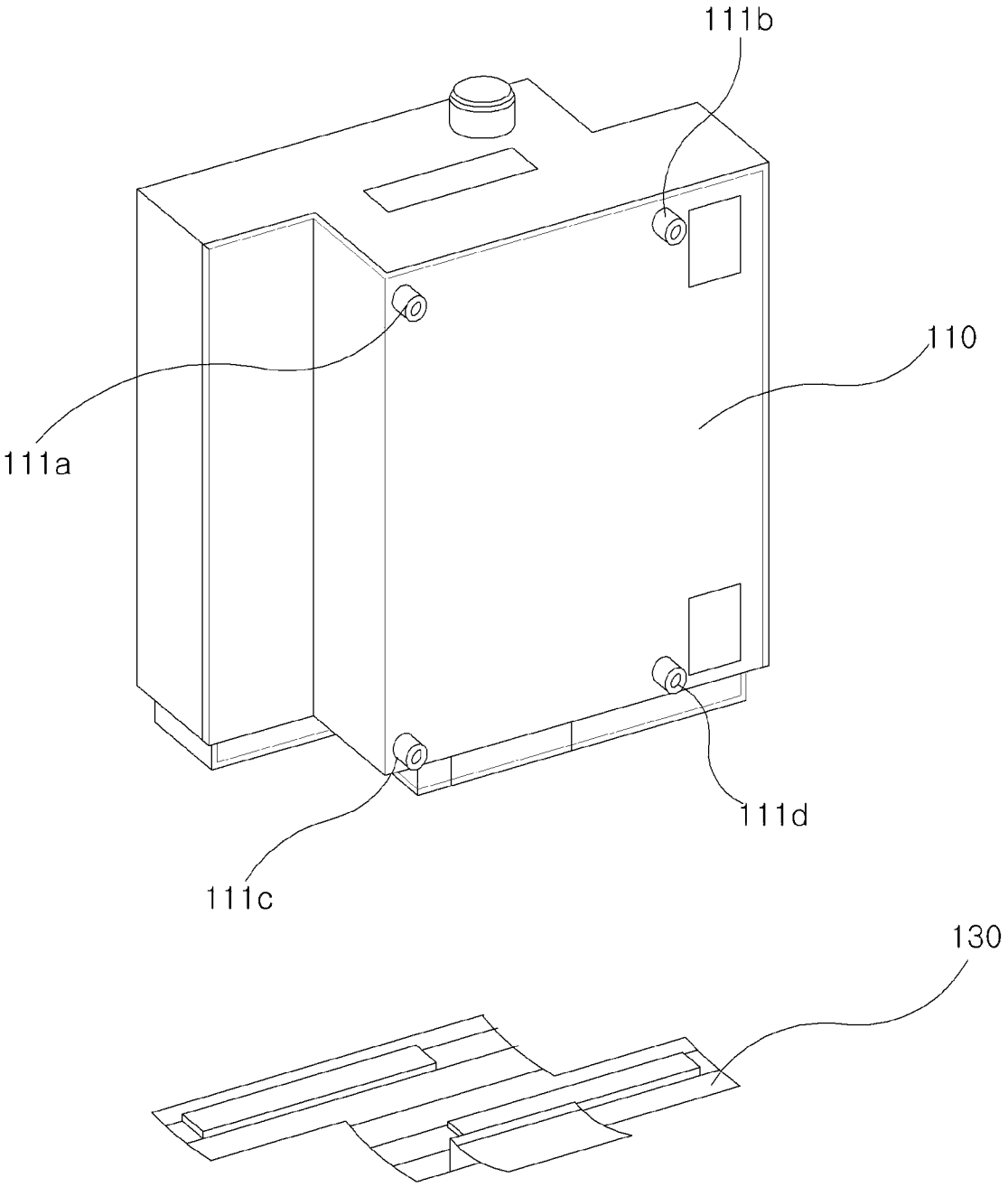
FIG. 2 is an exploded perspective view of an ink cartridge according to an embodiment of the present invention.
Figure 3:
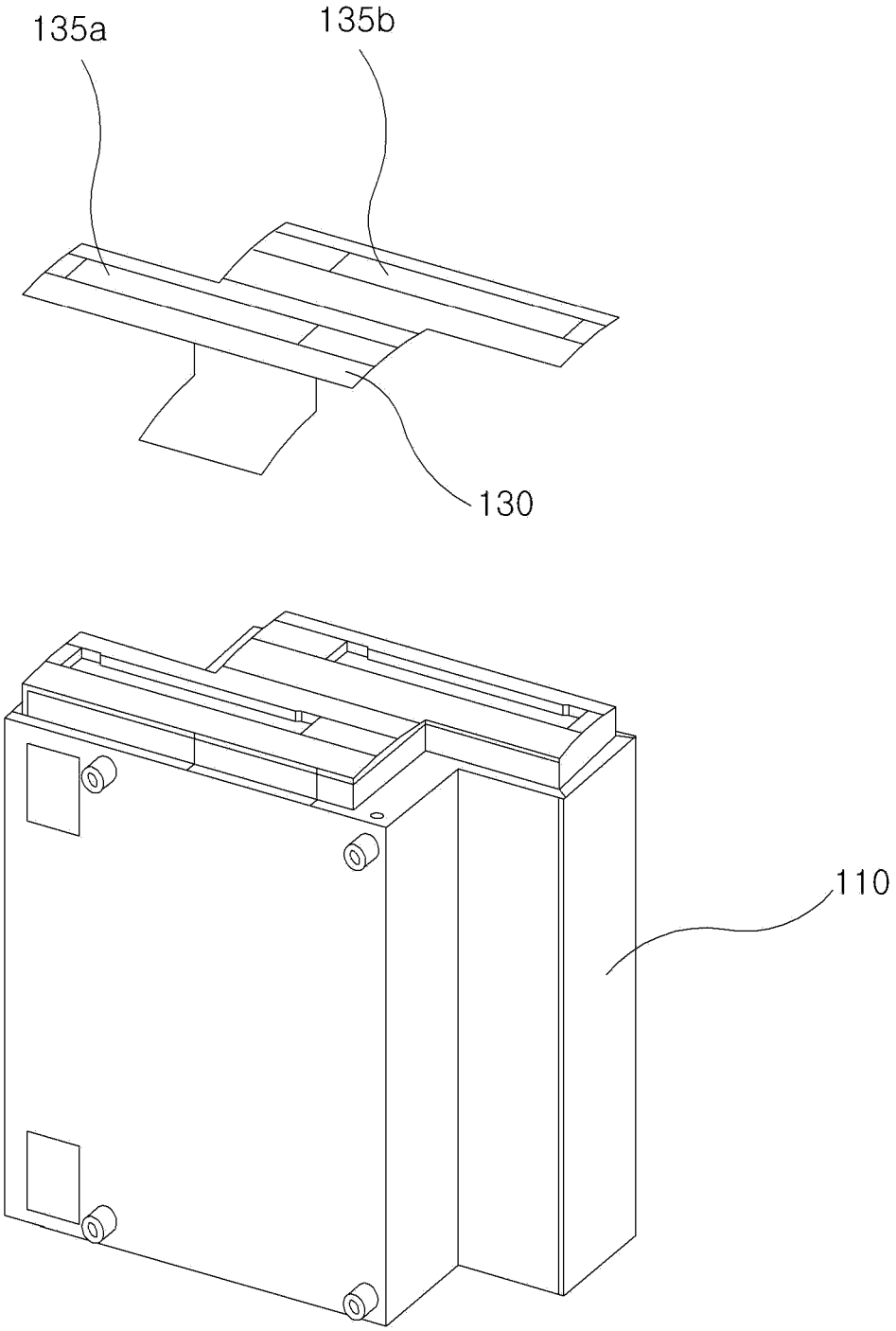
FIG. 3 is an exploded perspective view in another direction of the ink cartridge according to an embodiment of the present invention.

FIG. 1 is a view of an external shape of an ink cartridge, according to an embodiment of the present invention, FIG. 2 is an exploded perspective view of an ink cartridge according to an embodiment of the present invention, and FIG. 3 is an exploded perspective view in another direction.

Referring to FIGS. 1 through 3, an ink cartridge 100 may include an ink cartridge module 110 and a flexible printed circuit board 130.

The ink cartridge module 110 stores ink therein and includes a pair of heads 135*a* and 135*b* at a bottom surface, thereby ejecting ink through nozzles provided at the heads 135*a* and 135*b* according to an external control signal. The ink cartridge module 110 may further include a filter (not shown) for preventing impurities from flowing into the head or an inlet hole (not shown) that is a passage through which ink that passed through the filter is supplied to the head.

The flexible printed circuit board 130 is connected to the ink cartridge module 110 on a circuit configuration, and may include a chip related to control of the ink cartridge module 110. The flexible printed circuit board 130 may also be connected to a circuit board (not shown) including a circuit for controlling the ink cartridge module 110, on a circuit configuration.

Bosses and thread grooves 111*a* through 111*d* for screw combination with the circuit board are formed on one side surface of the ink cartridge module 110, and thus the circuit board may be fixed to the one side surface of the ink cartridge module 110.

Figure 4:
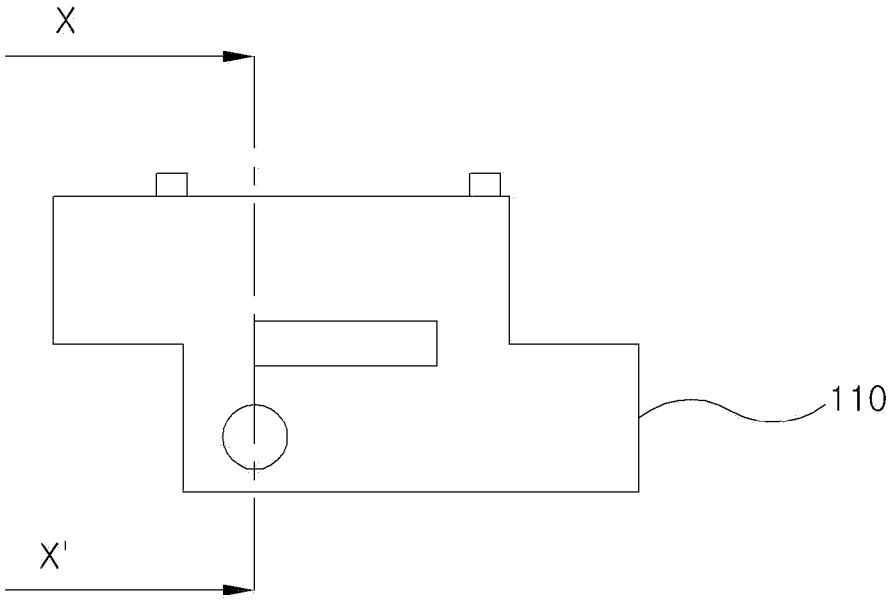
FIG. 4 is a plan view and a bottom view of an ink cartridge module according to an embodiment of the present invention.
Figure 4:
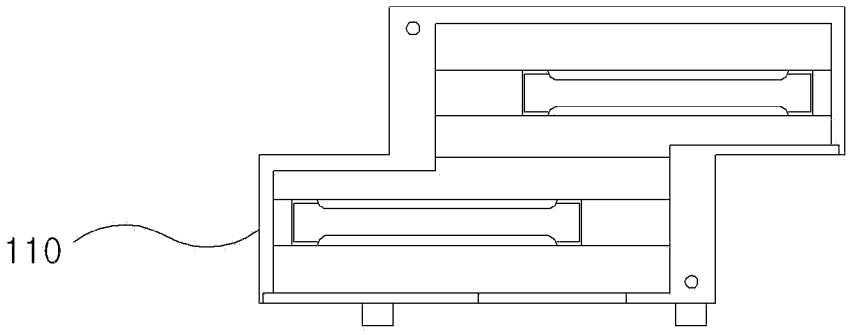

FIG. 4(*a*) is a plan view of an ink cartridge module according to an embodiment of the present invention, and FIG. 4(*b*) is a bottom view of the ink cartridge module according to an embodiment of the present invention.

Referring to FIG. 4, the ink cartridge module 110 has a shape on the plan view, in which two rectangular shapes are misaligned and closely contact each other in a width direction. Here, a rectangular shape does not only mean a geometrically accurate rectangular shape. For example, even if a shape has four corners that are rounded or are partially somewhat protruded or dented, as long as the shape is considered as a rectangular shape, the shape is 'rectangular shape'.

Accordingly, a plurality of ink cartridge modules are adjacently provided in a length direction or a width direction to form an array in the length direction or the width direction.

Figure 5:
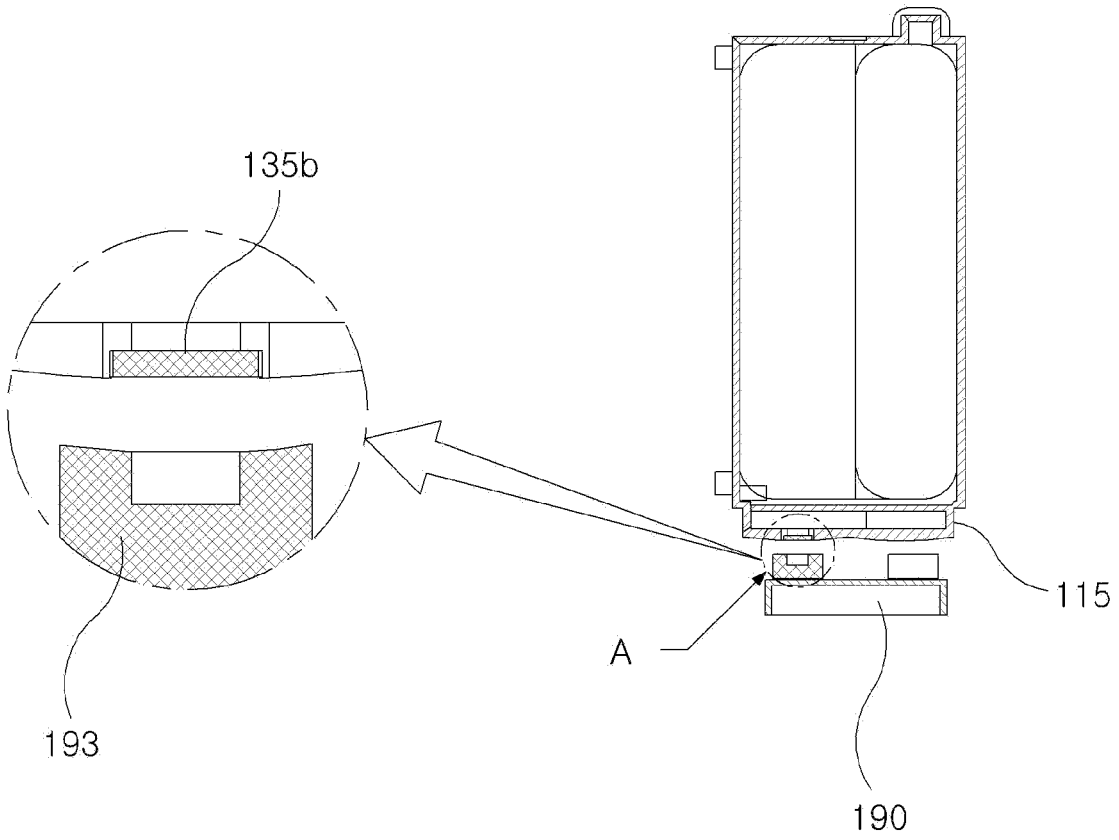
FIG. 5 is a cross-sectional view of an ink cartridge taken along a line X-X' of FIG. 4.
Figure 6:
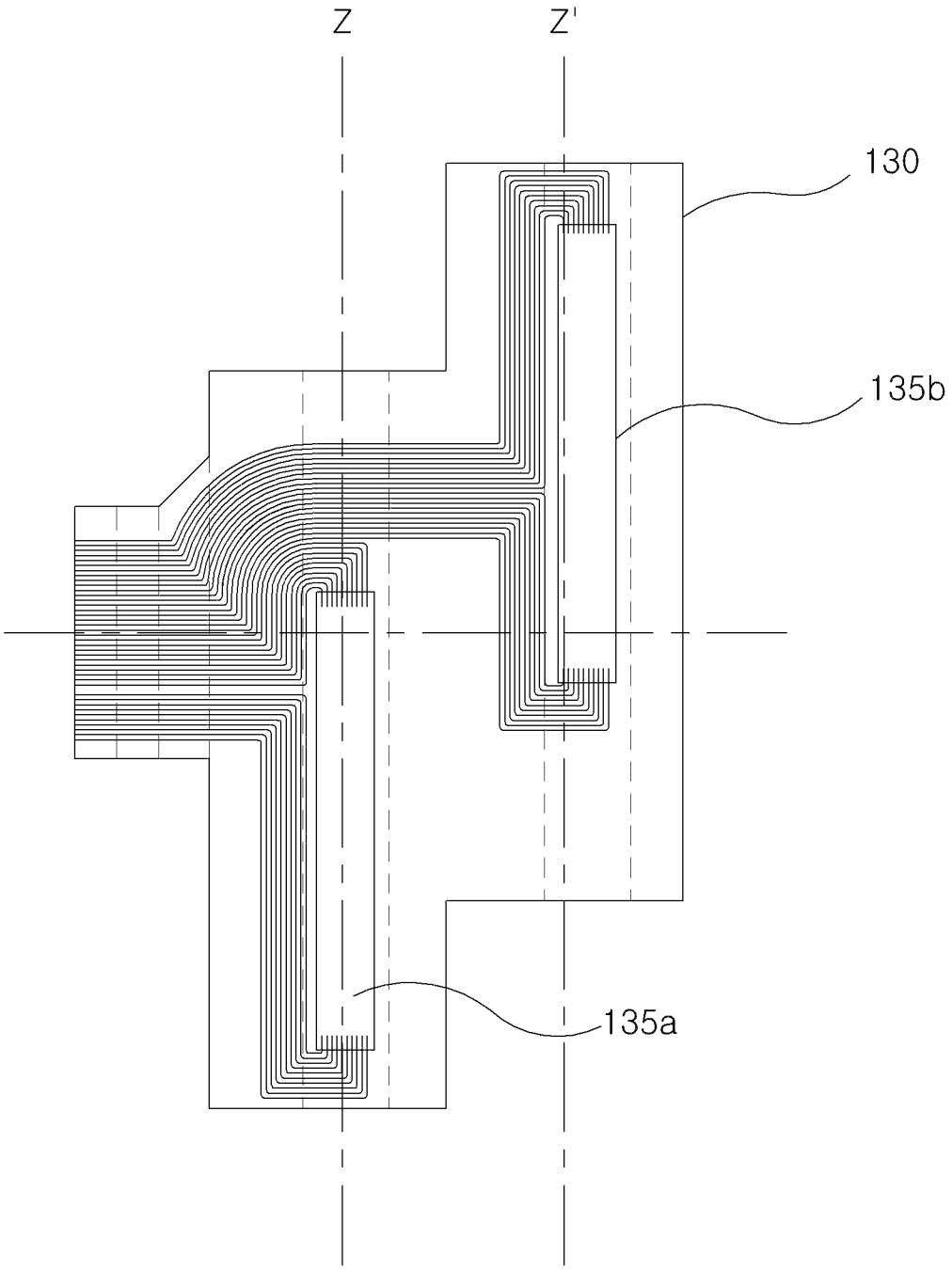
FIG. 6 is a view being referred to, to describe an arrangement of a head.

FIG. 5 is a cross-sectional view of an ink cartridge taken along a line X-X' of FIG. 4, and FIG. 6 is a view being referred to, to describe an arrangement of a head.

Referring to FIG. 5, a cross-section of a region A where the head 135*b* is provided at a bottom of the ink cartridge module 110 has an incline raising towards a width direction of the head 135*b* at two sides based on a horizontal head surface of the head 135*b*.

However, as shown in FIG. 6, since the pair of heads 135*a* and 135*b* are slightly misaligned from central axes z and z' so as to obtain a space for a connection with the flexible printed circuit board 130, lengths and inclining angles of the inclines formed at two sides of the head surfaces of the heads 135*a* and 135*b* are different from each other.

Such shapes of the inclines enable easy internal wiring, and also prevent a print medium passing through the heads 135*a* and 135*b* during a print operation from being jammed.

A rubber cover plate 190 is provided at a bottom of the ink cartridge module 110, and a rubber cover 193 is provided at the rubber cover plate 190 so as to block a nozzle from the outside when a print operation is not performed. The rubber cover 193 may also have an incline having a shape corresponding to the incline formed at the two sides of the head surface so that ink is prevented from flowing to the outside by using the incline formed at the rubber cover 193 even when ink is excessively discharged.

A stepped portion 115 that is stepped inward is also provided at a lower circumference of the ink cartridge module 110 so as to fix the ink cartridge module 110 to an external fixing plate and align a fixed location.

The external fixing plate includes a rib having a shape corresponding to the stepped portion 115, and such a rib not only aligns a fixed location such that the ink cartridge module 110 is fixed at a certain location together with the stepped portion 115, but also increases rigidity of the external fixing plate with respect to bending or twisting, thereby facilitating configuration of an array using several ink cartridges.

Figure 7:
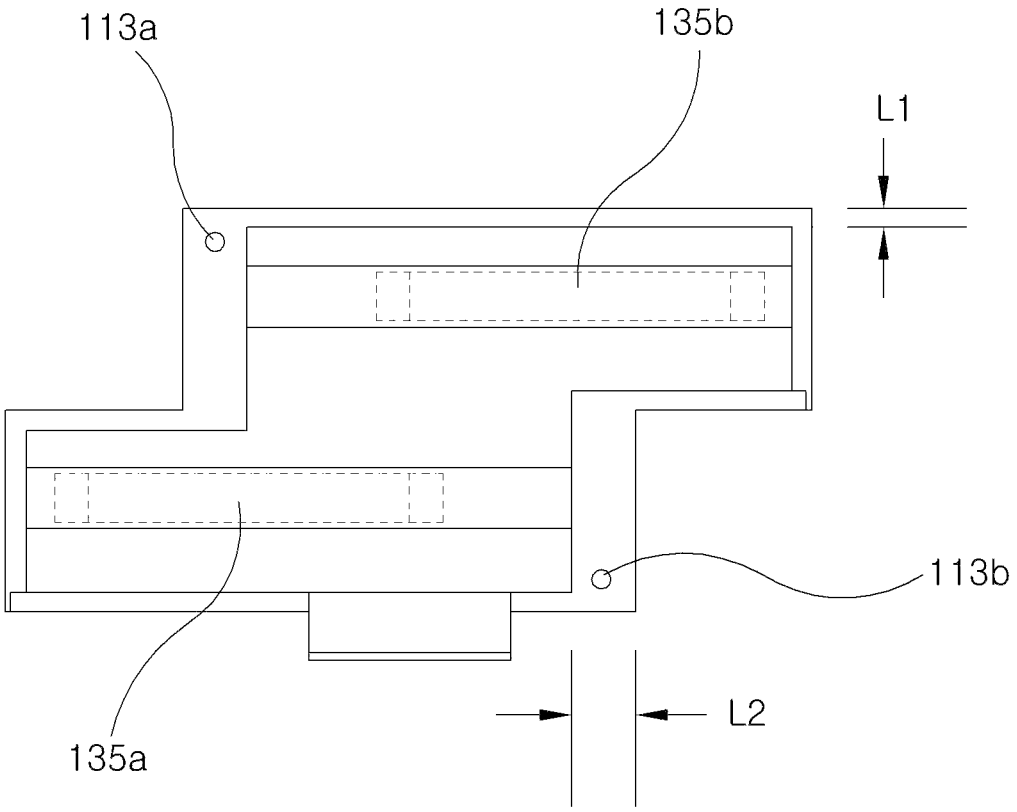
FIG. 7 is a bottom view of an ink cartridge according to an embodiment of the present invention.
Figure 8:
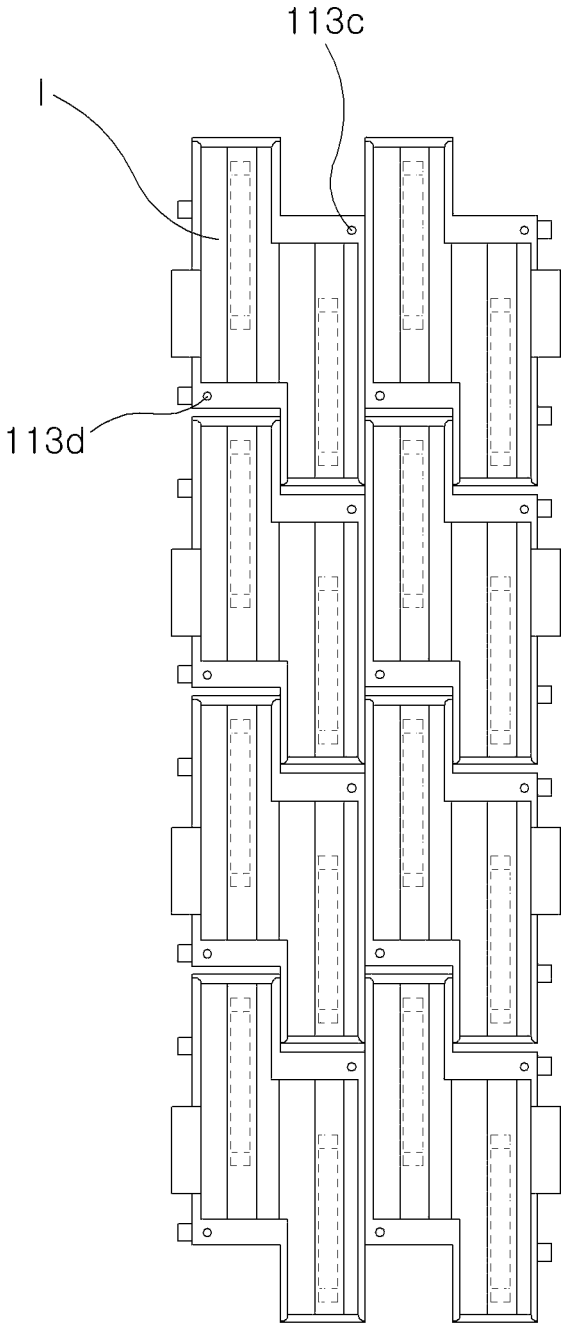
FIG. 8 is a bottom view of an array including a plurality of ink cartridges.

FIG. 7 is a bottom view of an ink cartridge according to an embodiment of the present invention, and FIG. 8 is a bottom view of an array including a plurality of ink cartridges.

Referring to FIG. 7, fixing grooves 113*a* and 113*b* for fixing the ink cartridge module 110 to the external fixing plate by inserting a coupling member and aligning a fixed location for fixing the ink cartridge module 110 at a certain location are formed at a bottom surface of the ink cartridge module 110.

In order to form the stepped portion 115, the ink cartridge module 110 is sunken inward by a length L1, but regions where the fixing grooves 113*a* and 113*b* are provided are sunken inward by a length L2 that is longer than the length L1.

Such fixing grooves 113*a* and 113*b* enable only a malfunctioning ink cartridge to be easily replaced when several ink cartridges form an array. For example, as shown in FIG. 8, when an array is formed by using 8 ink cartridges and an ink cartridge denoted by a reference numeral I is malfunctioning, a coupling member inserted into fixing grooves 113*c* and 113*f* of the malfunctioning ink cartridge I may be removed and the malfunctioning ink cartridge I may be easily replaced by another ink cartridge. Accordingly, only the malfunctioning ink cartridge I may be replaced without having to replace the entire array.

Figure 9:
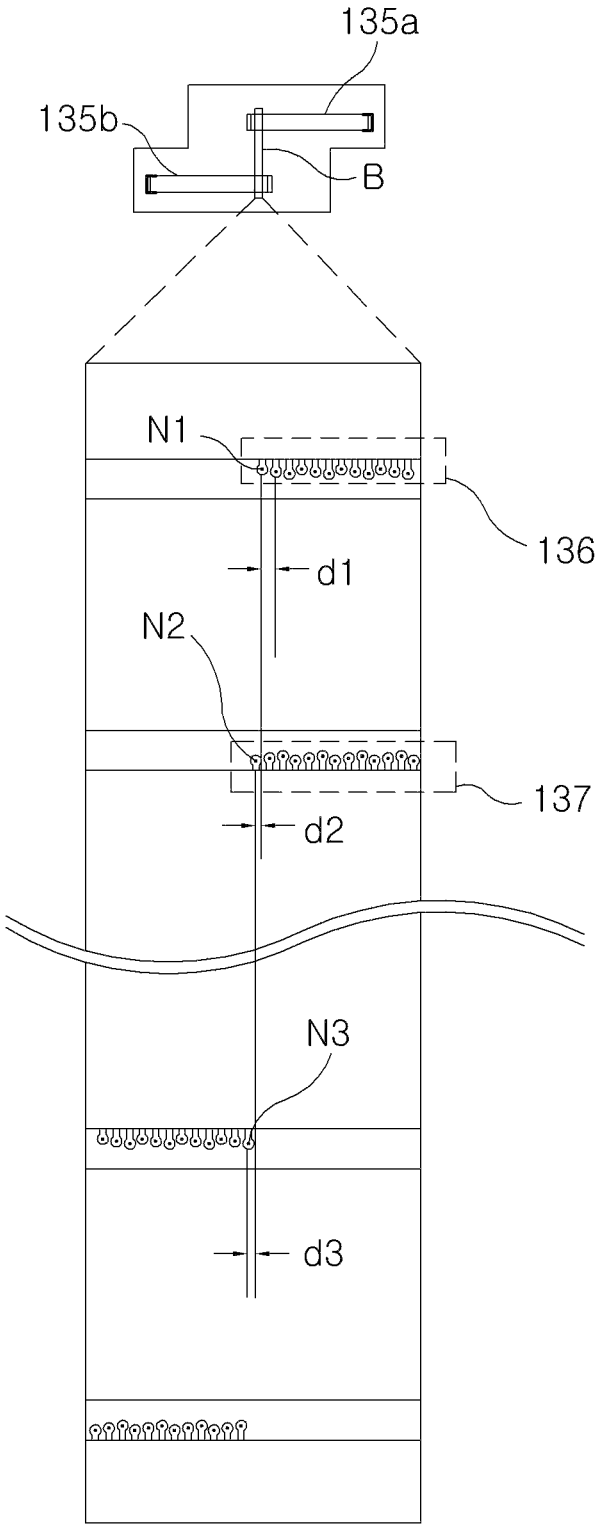
FIGS. 9 and 10 are partially enlarged views of nozzles provided at a head.
Figure 10:
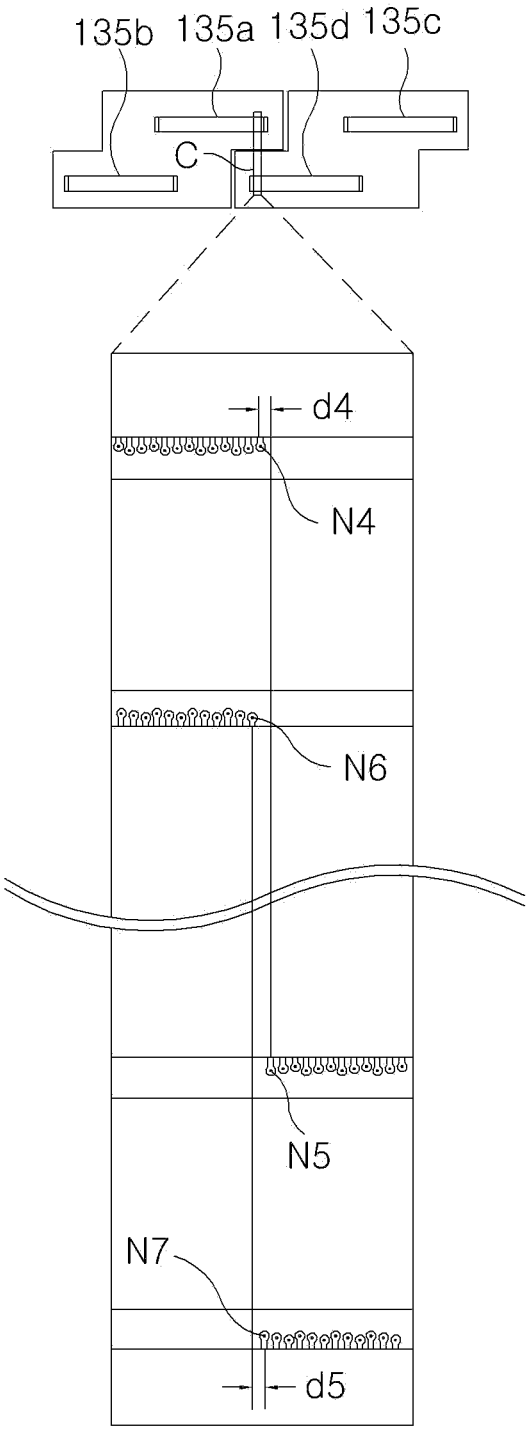

FIGS. 9 and 10 are partially enlarged views of nozzles provided at a head.

FIG. 9 is an enlarged view of a region B in the nozzles provided at the first and second heads 135*a* and 135*b*, and resolution may be twice high since nozzles 136 provided in a first row and nozzles 137 provided in a second row of the first head 135*a* are misaligned. In other words, when a nozzle interval d1 of the nozzles 136 in the first row is 1/resolution inch (dot per inch (DPI)), an interval d2 between a nozzle N1 from among the nozzles 136 in the first row and a nozzle N2 adjacent to the nozzle N1 from among the nozzles 137 in the second row is 1/(resolution×2) inch. Accordingly, when 300 dpi resolution is realizable by the nozzles 136 in the first row, 600 dpi resolution is realizable by all of the nozzles 136 in the first row and the nozzles 137 in the second row.

In order to uniformly increase a print width as such, an interval d3 between the nozzle N2 at the end of the first head 135*a* and a nozzle N3 at the end of the second head 135*b* has to be 1/(resolution×2) inch.

FIG. 10 is an enlarged view of a region C in the nozzles provided at the first ink cartridge head 135*a* and nozzles provided at a second ink cartridge head 135*d* when two ink cartridges are arranged in a length direction.

As shown in FIG. 10, even when the two ink cartridges are arranged in the length direction, in order to increase a print width while resolution is uniform, an interval d4 between a nozzle N4 at the end of the first row of the first ink cartridge head 135*a* and a nozzle N5 at the end of a first row of the second ink cartridge head 135*d* and an interval d5 between a nozzle N6 at the end of a second row of the first ink cartridge head 135*a* and a nozzle N7 at the end of a second row of the second ink cartridge head 135*d* may be the same as the nozzle interval d1 in the nozzles at the same row, as shown in FIG. 9.

Figure 11:
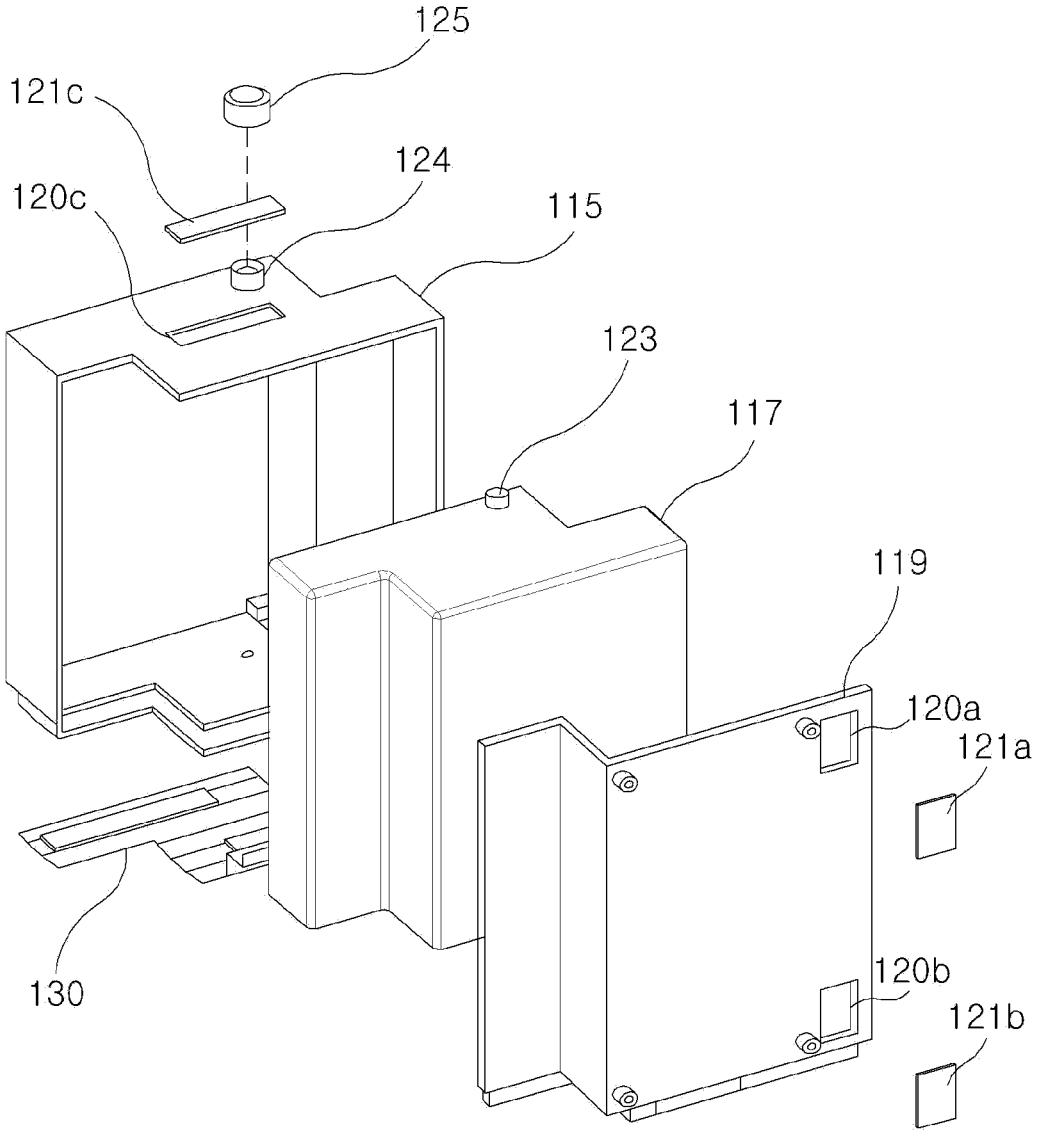
FIG. 11 is an exploded perspective view of an ink cartridge module.

FIG. 11 is an exploded perspective view of an ink cartridge module.

Referring to FIG. 11, the ink cartridge module 110 may include a head portion 115, an ink reservoir 117, and a cover portion 119.

The pair of heads 135*a* and 135*b* including a plurality of nozzles are provided at a bottom surface of the head portion 115, and ink is stored in the ink reservoir 117. The cover portion 119 is combined with the head portion 115 so as to form a space in which the ink reservoir 117 is accommodated. The ink reservoir 117 may be an ink carton formed of a transparent and ductile material, such as vinyl.

The ink reservoir 117 may include an ink inlet hole 123 for charging ink, and the head portion 115 includes a hole 124 for injecting ink to the ink inlet hole 123. The ink inlet hole 123 is sealed by an ink inlet hole cap 125.

Check windows 120*a* through 120*c* for checking a remaining amount of ink in the ink reservoir 117 are formed on the head portion 115 and the cover portion 119, and check window covers 121*a* through 121*c* may be provided on the check windows 120*a* through 120*c*.

Figure 12:
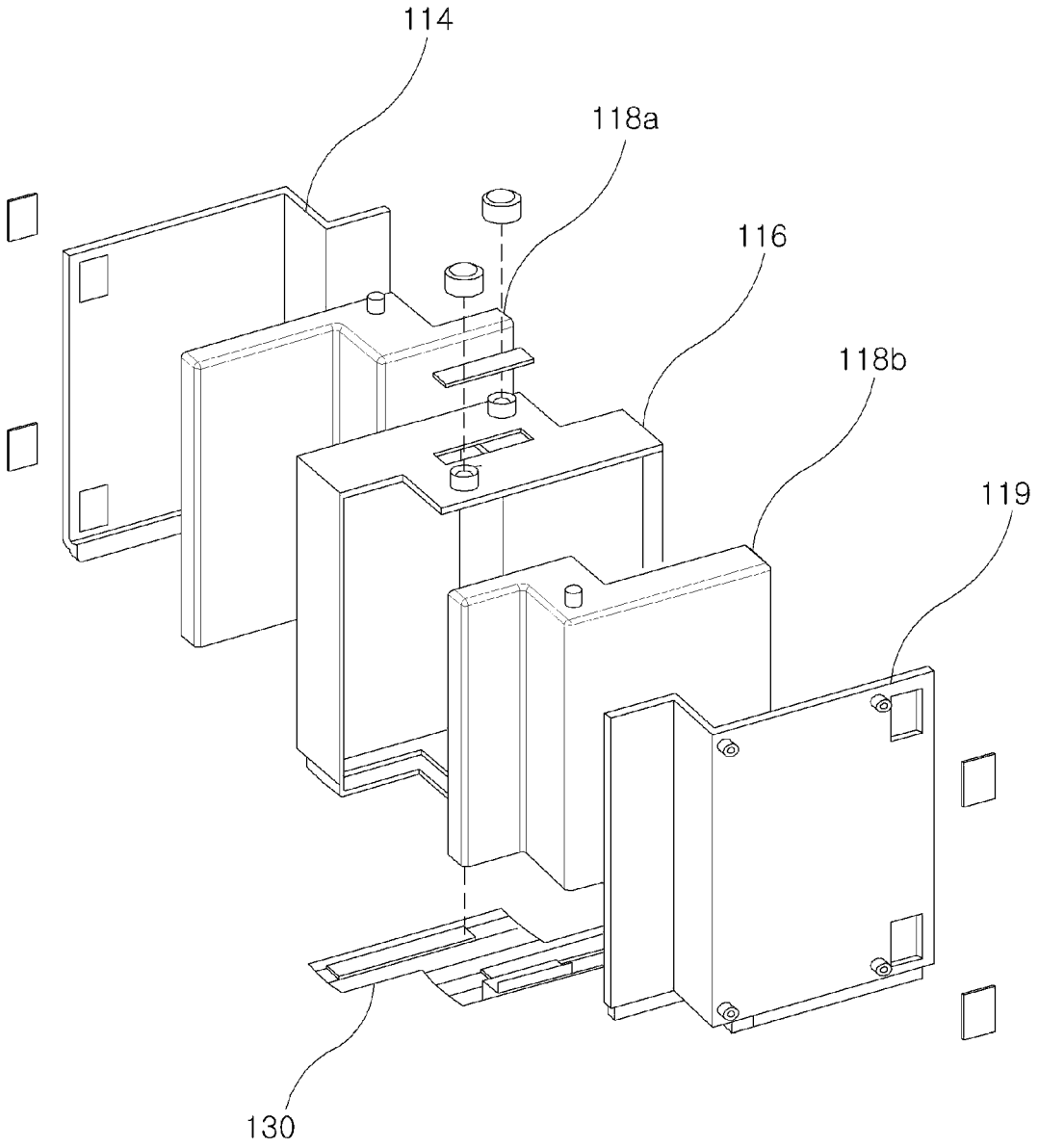
FIG. 12 is an exploded perspective view of an ink cartridge module according to another embodiment.

FIG. 12 is an exploded perspective view of an ink cartridge module according to another embodiment.

An ink cartridge according to the current embodiment basically has the same structure as that described above. However, an ink cartridge 200 according to the current embodiment includes two ink reservoirs 118*a* and 118*b*, wherein a first cover 114 and a second cover 119 combine with a head portion 116 to form spaces for accommodating the two ink reservoirs 118*a* and 118*b*.

In other words, the head portion 116 divides an internal space for storing ink in the ink cartridge module 110 into two spaces, and the ink reservoirs 118*a* and 118*b* are separately accommodated in the divided spaces. The two ink reservoirs 118*a* and 118*b* may store different colors of ink.

Figure 13:
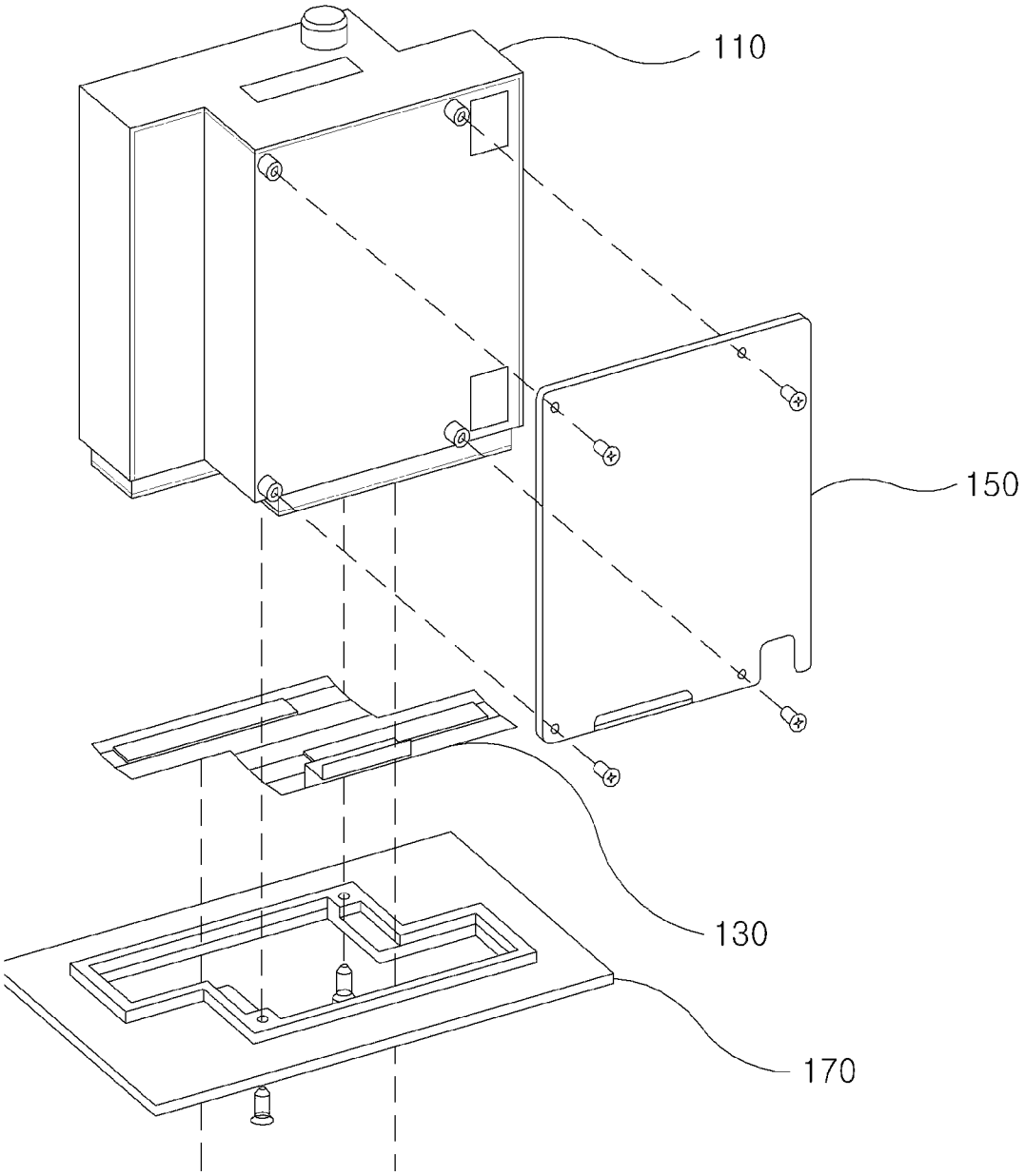
FIG. 13 is a view of a circuit board and a fixing connection plate.

FIG. 13 is a view of an ink cartridge module, and a circuit board and a fixing plate.

Referring to FIG. 13, a circuit board 150 including a circuit for controlling the ink cartridge module 110 is fixed to a side surface of the ink cartridge module 110 via screw-combination. Also, the flexible printed circuit board 130 may be detachably connected to the circuit board 150 via a connector manner.

A fixing plate 170 includes an accommodation protrusion having a shape corresponding to the head portion 115 of the ink cartridge module 110, and a connection hole through which the coupling member inserted into the fixing grooves 113*a* and 113*b* penetrates, thereby not only fixing the ink cartridge module but also aligning a fixed location to a certain location.

Figure 14:
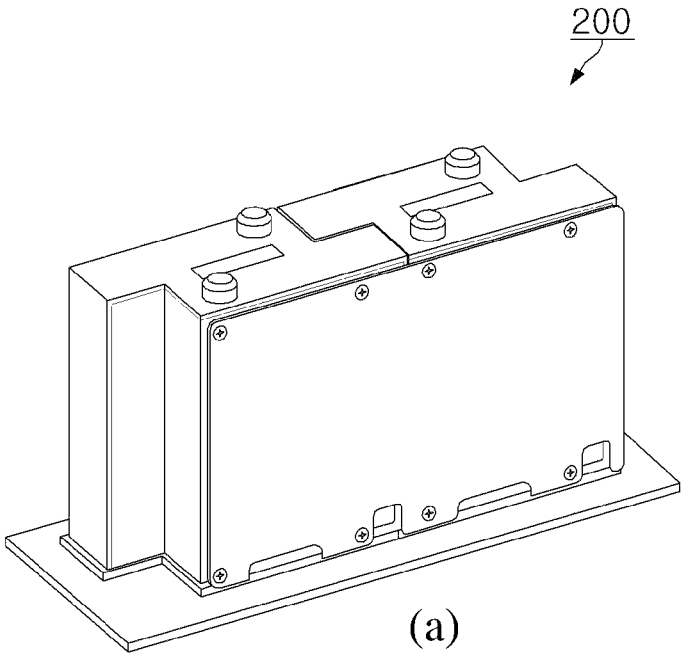
FIGS. 14 and 15 are views of an array in which two or more ink cartridge modules are adjacently provided.
Figure 14:
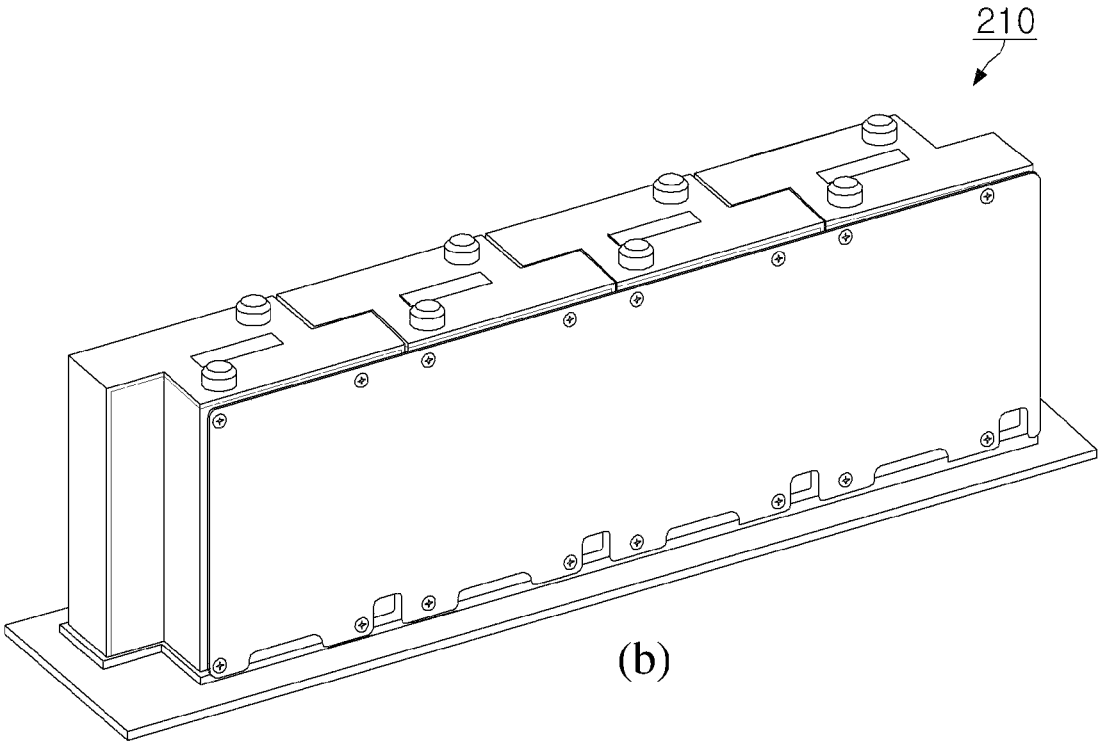
Figure 15:
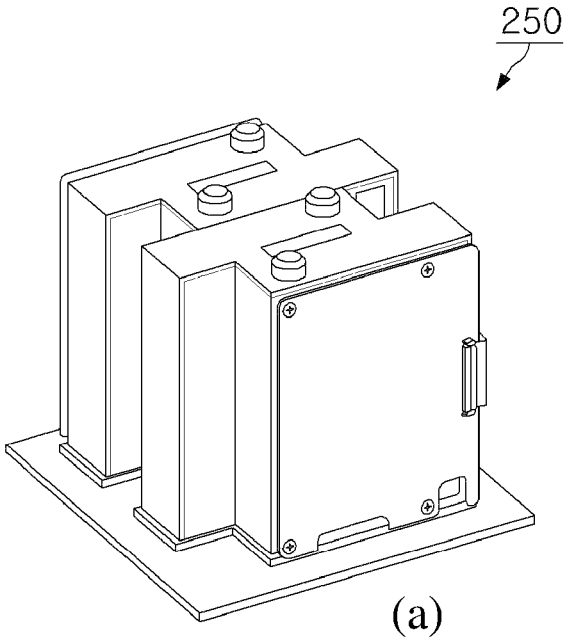
Figure 15:
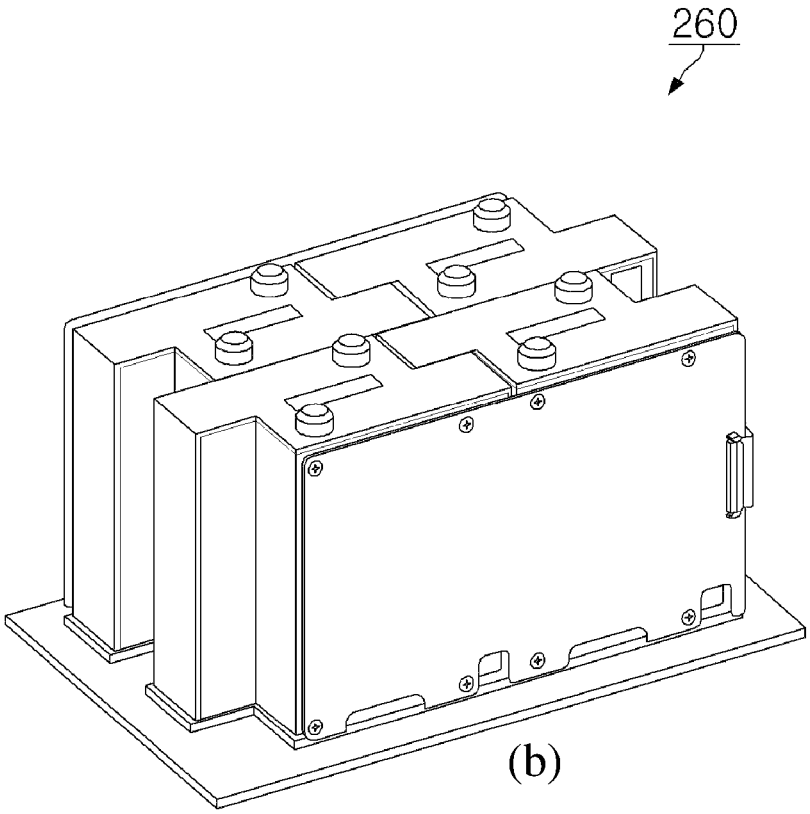

FIGS. 14 and 15 are views of an array in which two or more ink cartridge modules are adjacently provided.

As shown in FIG. 14(*a*), an array type ink cartridge 200 in which two ink cartridges are arranged such that a head extends in a length direction may be used. Alternatively, as shown in FIG. 14(*b*), an array type ink cartridge 210 in which four ink cartridges are arranged such that a head extends in a length direction may be used. In other words, the number of ink cartridges extendable in the length direction is not limited, and may be arbitrary based on characteristics of an apparatus being used.

When an array is formed as such, a print width printable at one time is extended, and thus a print speed may be increased.

An array type ink cartridge 250 in which two ink cartridges are arranged as shown in FIG. 15(*a*) or an array type ink cartridge 260 in which four ink cartridges are arranged such that a head extends in a width direction may be used. In this case as well, the number of ink cartridges extendable in the width direction is not limited.

When an array is formed as such, ink reservoirs may store ink having colors, such as cyan, magenta, yellow, black, etc., and the array may be used in a color print apparatus.

Meanwhile, the ink cartridge according to the present invention is not limitedly applied to the embodiments described above, and some or all embodiments may be selectively combined for various modification.

While this invention has been particularly shown and described with reference to embodiments thereof, it will be understood by those of ordinary skill in the art that various changes in form and details may be made therein without departing from the spirit and scope of the invention as defined by the appended claims.

INDUSTRIAL APPLICABILITY

The present invention may be used in an ink cartridge capable of realizing various sizes of print widths and various colors by adjacently providing one or more ink cartridge modules.

What is claimed is:

1. An ink cartridge comprising:

an ink cartridge module comprising a space for storing ink and a pair of heads misaligned such that a print width is extended; and a flexible print circuit board connected to the ink cartridge module on a circuit configuration, wherein the ink cartridge module has a cross-sectional shape in which two rectangular shapes having long sides and short sides closely contact each other such that the long sides of the two rectangular shapes partially overlap, and thus are capable of configuring an array in a direction of either the long side or the short side.

2. The ink cartridge of claim 1, wherein a fixing groove for fixing the ink cartridge module to an external fixing plate and aligning a fixed location by inserting a coupling member is formed on a bottom surface of the ink cartridge module.

3. The ink cartridge of claim 1, wherein a boss and a thread groove for screw-combining with a circuit board in which a circuit for controlling the ink cartridge module is provided are formed on one side surface of the ink cartridge module.

4. The ink cartridge of claim 3, wherein the flexible printed circuit board and the circuit board in which the circuit for controlling the ink cartridge module is provided are detachably connected to each other in a connecter manner.

5. The ink cartridge of claim 1, wherein a head surface of the pair of heads from which the ink is ejected is horizontal, and a bottom surface of the ink cartridge module has an incline raising towards a width direction of the pair of heads at two sides based on the head surface.

6. The ink cartridge of claim 1, wherein a stepped portion stepped inward to be combined with an external fixing plate and to align a combined location is formed on a lower circumference of the ink cartridge module.

7. The ink cartridge of claim 1, wherein the ink cartridge module further comprises a check window for checking a remaining amount of ink, an ink injection hole for charging ink in the space for storing ink, and a cap for sealing the ink injection hole.

8. The ink cartridge of claim 1, wherein the space for storing ink is divided into two spaces by a barrier wall, wherein the two spaces accommodate different ink reservoir

* * * * *